US012226707B2

(12) United States Patent
Tsai

(10) Patent No.: US 12,226,707 B2
(45) Date of Patent: Feb. 18, 2025

(54) QUICK-RELEASE BEARING SYSTEM FOR GAME TABLE

(71) Applicant: Medal Sports (Taiwan) Corporation, Taipei (TW)

(72) Inventor: Kevin Chunhao Tsai, Kaohsiung (TW)

(73) Assignee: MEDAL SPORTS (TAIWAN) CORPORATION, Taipei (TW)

( * ) Notice: Subject to any disclaimer, the term of this patent is extended or adjusted under 35 U.S.C. 154(b) by 387 days.

(21) Appl. No.: 17/737,176

(22) Filed: May 5, 2022

(65) Prior Publication Data

US 2022/0355187 A1 Nov. 10, 2022

Related U.S. Application Data

(60) Provisional application No. 63/186,663, filed on May 10, 2021.

(51) Int. Cl.
*A63F 7/06* (2006.01)

(52) U.S. Cl.
CPC ..... *A63F 7/0672* (2013.01)

(58) Field of Classification Search
CPC ..... A63F 7/0672; A63F 7/06; A63F 7/07
USPC ..... 273/108.1, 108.4, 108.5, 108.52, 108.54, 273/108.56; 473/14; 384/215, 217, 252, 384/428, 440
See application file for complete search history.

(56) References Cited

U.S. PATENT DOCUMENTS 3,724,851 A * 4/1973 Cecchetti ..... A63F 7/0676 273/108.52
4,358,165 A * 11/1982 Julius ..... F16C 33/20 384/252
5,630,760 A * 5/1997 Brown ..... A63F 7/36 273/108.52
6,155,564 A * 12/2000 Tsai ..... A63F 7/3603 273/108.52
6,347,797 B1 * 2/2002 Tsai ..... A63F 7/0672 473/41
6,349,939 B1 * 2/2002 Tsai ..... A63D 15/04 473/10
9,498,677 B2 * 11/2016 Raniere ..... A63B 21/05
(Continued)

FOREIGN PATENT DOCUMENTS

DE 202011104972 U1 * 12/2011 ..... A63F 7/0672

OTHER PUBLICATIONS

Original and translation of DE-102007054409-A1, titled "Table football device has corpus, which has playing surface . . . ", Inventor Lechmacher, Marc; published May 14, 2009. (Year: 2009).*

*Primary Examiner* — Sebastiano Passaniti
(74) *Attorney, Agent, or Firm* — Dickinson Wright PLLC

(57) ABSTRACT

A quick release system for a rod of a table is disclosed. The rod can have an axis and the rod can be axially slidable and rotatable about the axis relative to the table. The system can include a mount having a slot that extends downward to and is in communication with holes in the mount. The mount can be mounted adjacent a top side wall of the table. The system also can have a bearing with an axial hole that receives the rod. The bearing can have tabs that extend downward below the axial hole to mount the rod to the table by inserting the bearing into the slot so that the tabs engage and are retained by the holes, respectively, in an engaged position. In a disengaged position, the tabs can be manually released from the holes to release the bearing and the rod from the mount.

18 Claims, 5 Drawing Sheets

(56) References Cited

U.S. PATENT DOCUMENTS

| | | | | |
|---|---|---|---|---|
| 9,962,604 | B1 * | 5/2018 | Farley | A63F 7/0672 |
| 10,617,939 | B2 * | 4/2020 | Tsai | A63F 7/06 |
| 2007/0216101 | A1 * | 9/2007 | Padilla | A63F 7/36<br>273/108.3 |

* cited by examiner

QUICK-RELEASE BEARING SYSTEM FOR GAME TABLE

This application claims priority to and the benefit of U.S. Prov. Pat. App. No. 63/186,663, filed May 10, 2021, which is incorporated herein by reference in its entirety.

BACKGROUND

Field of the Disclosure

The present disclosure relates in general to mounts for the axially slidable and rotatable (i.e., about the same axis) rods of a foosball table, also known as table football or table soccer. More specifically, various embodiments include apparatus and methods for quickly and easily installing or removing the rods of a foosball table via bearings that do not require disassembly of the rods themselves.

Description of the Prior Art

Typically, a foosball table includes holes on both sides of the table through which the foosball rods are mounted. To install or remove a conventional rod, the rod itself must be disassembled so that a portion of the rod can be removed from both mounting holes. Since disassembly and re-assembly required, each installation or removal of a foosball rod can take a considerable amount of time and physical effort. Accordingly, improvements to reduce the time and effort needed to install or remove a foosball rod from a foosball table continue to be of interest, particularly with game tables that can be reconfigured for different games other than foosball.

SUMMARY

Embodiments of a quick release system for a foosball rod of a foosball table are disclosed. For example, the foosball rod can have an axis and the foosball rod can be axially slidable and rotatable about the axis relative to the foosball table. The quick release system can include a mount having a vertical slot that extends downward to and is in communication with horizontal holes in the mount. The mount can be configured to be mounted adjacent a top side wall of the foosball table. The quick release system also can have a bearing with a horizontal axial hole that is configured to receive the foosball rod. The bearing can have tabs that extend downward below the horizontal axial hole to mount the foosball rod to the foosball table by inserting the bearing into the vertical slot so that the tabs engage and are retained by the horizontal holes, respectively, in an engaged position. In a disengaged position, the tabs can be manually released from the horizontal holes to release the bearing and the foosball rod from the mount.

BRIEF DESCRIPTION OF THE DRAWINGS

Before one or more embodiments are described in detail, one skilled in the art will appreciate that they are not limited in its application to the details of construction, the arrangements of components, and the arrangement of steps set forth in the following detailed description or illustrated in the drawings and descriptions. Rather, they are capable of other embodiments and of being practiced or being carried out in various ways. Also, it is to be understood that the phraseology and terminology used herein is for the purpose of description and should not be regarded as limiting.

DETAILED DESCRIPTION

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings.

Figure 1:
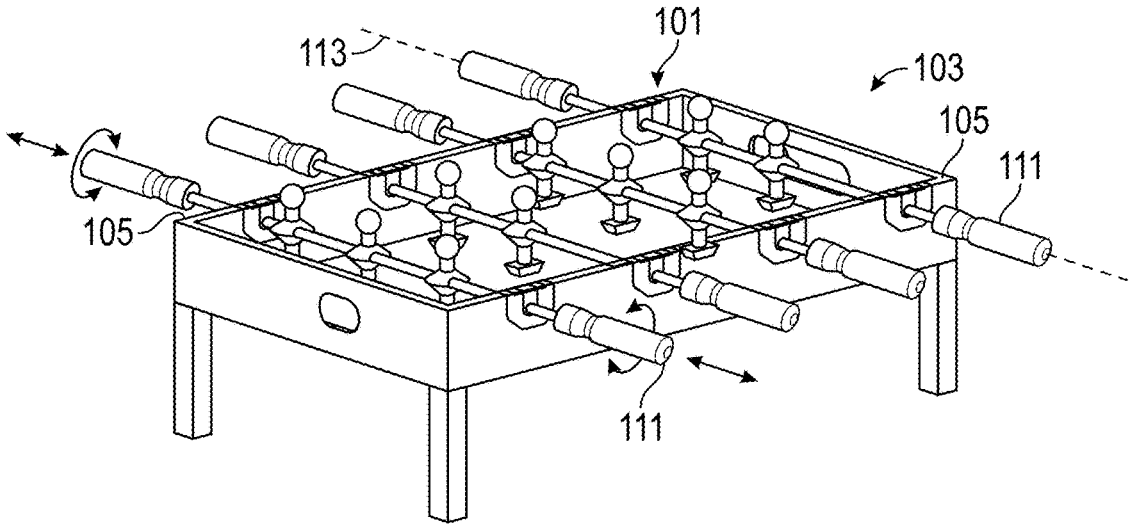
FIG. 1 is an isometric view of a foosball table with an embodiment of a quick release system for the foosball rods.
Figure 2:
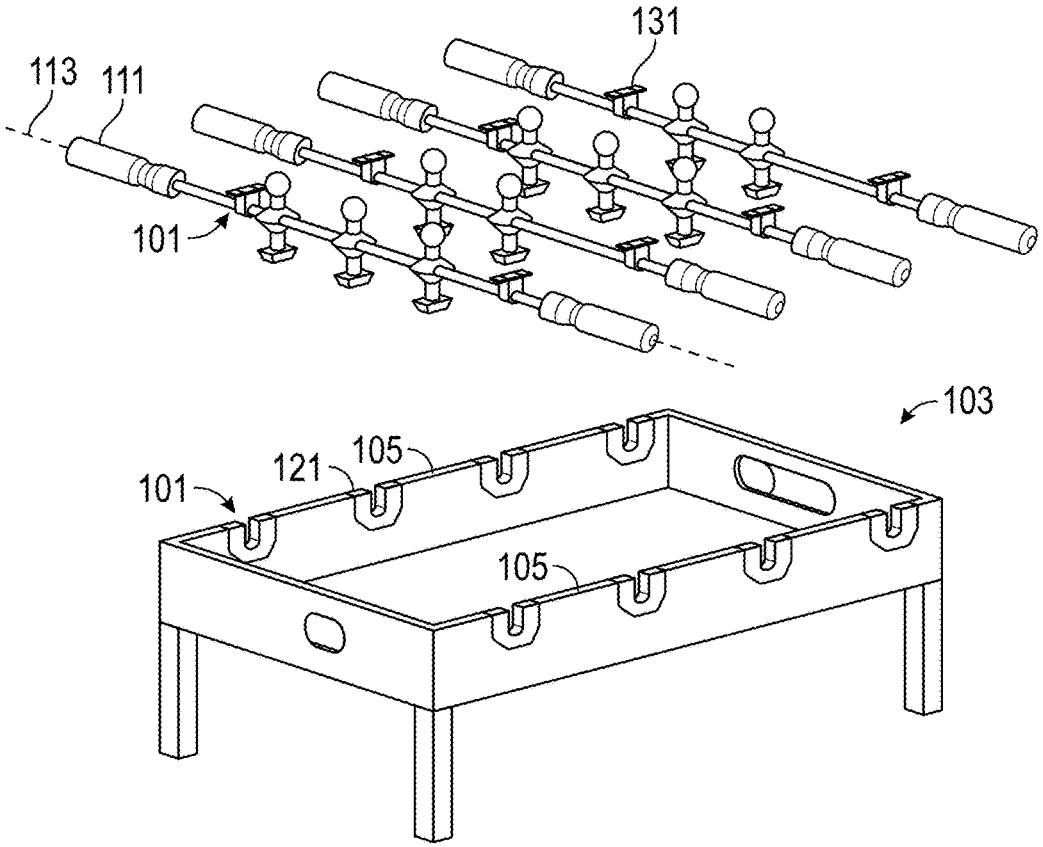
FIG. 2 is an exploded isometric view of the foosball table of FIG. 1, demonstrating the quick release foosball rods.
Figure 3:
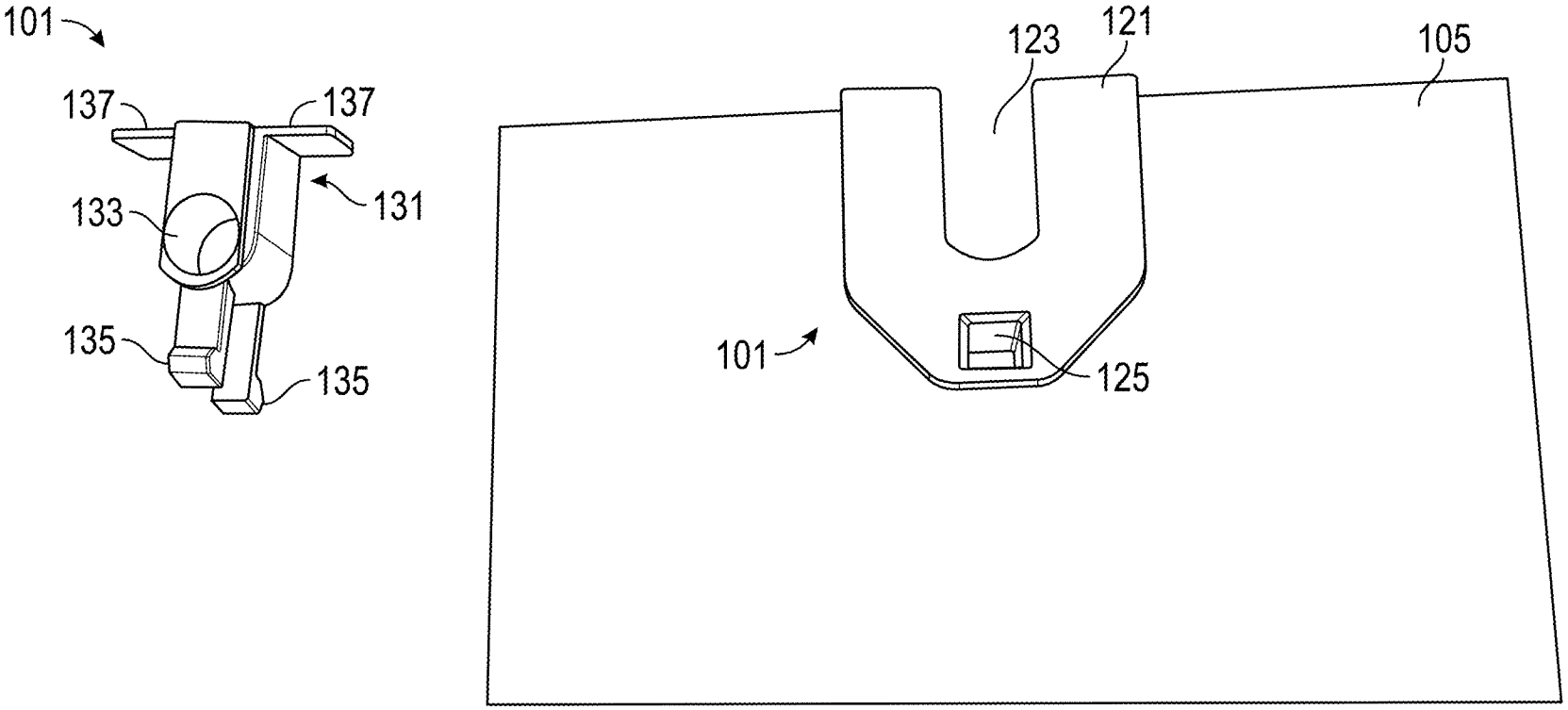
FIG. 3 is an enlarged isometric view of a portion of an embodiment of the quick release system.
Figure 4:
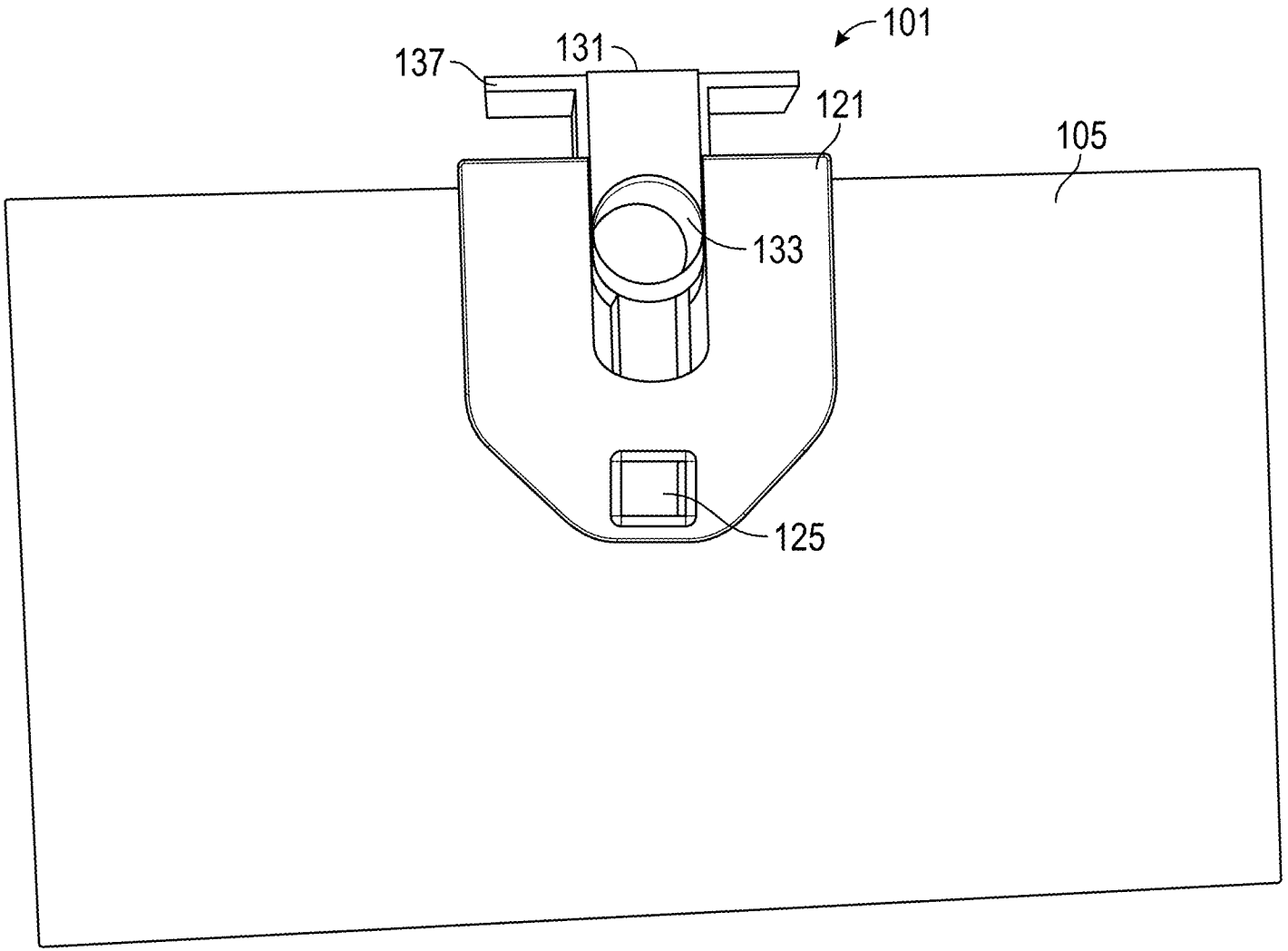
FIG. 4 is an isometric view of the quick release system of FIG. 3 partially assembled.
Figure 5:
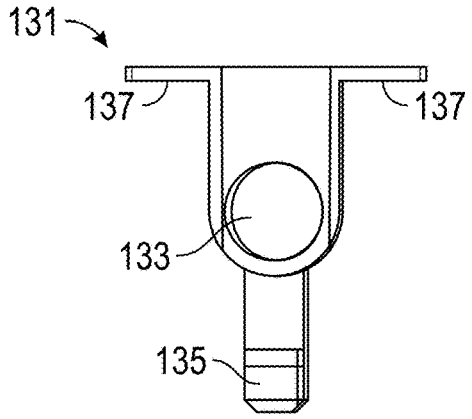
FIGS. 5-8 are front, side, top and bottom views, respectively, of an embodiment of a T-shaped bearing of the quick release system.
Figure 6:
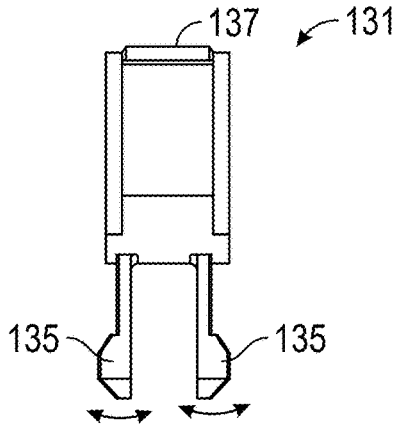
Figure 7:
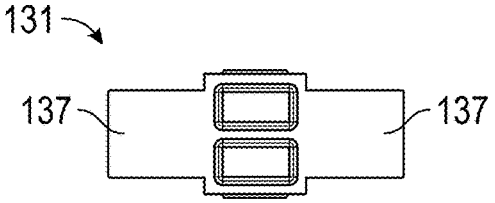
Figure 8:
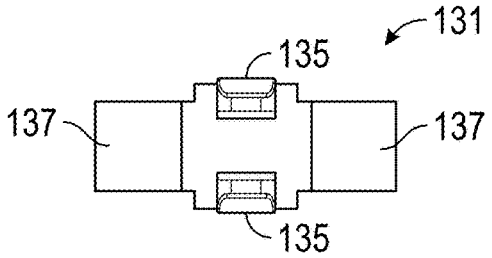
Figure 9:
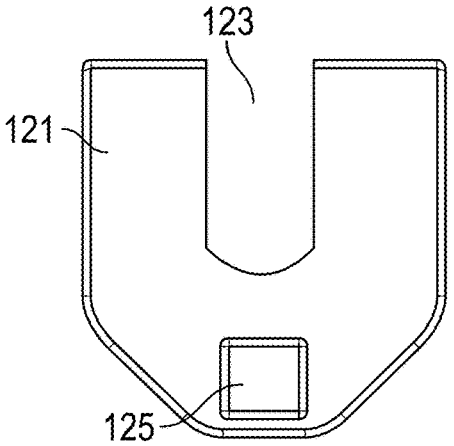
FIGS. 9-12 are front, side, top and bottom views, respectively, of an embodiment of a U-shaped mount of the quick release system.
Figure 10:
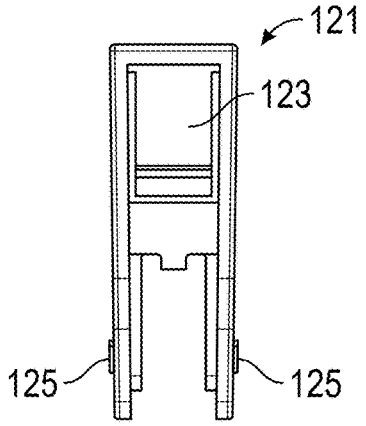
Figure 11:
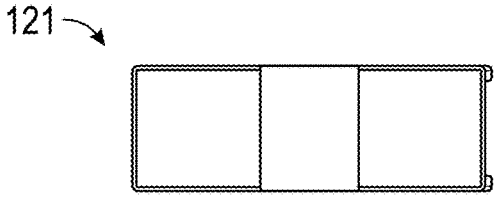
Figure 12:
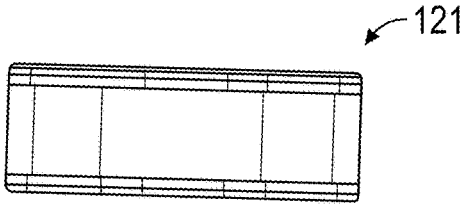
Figure 13:
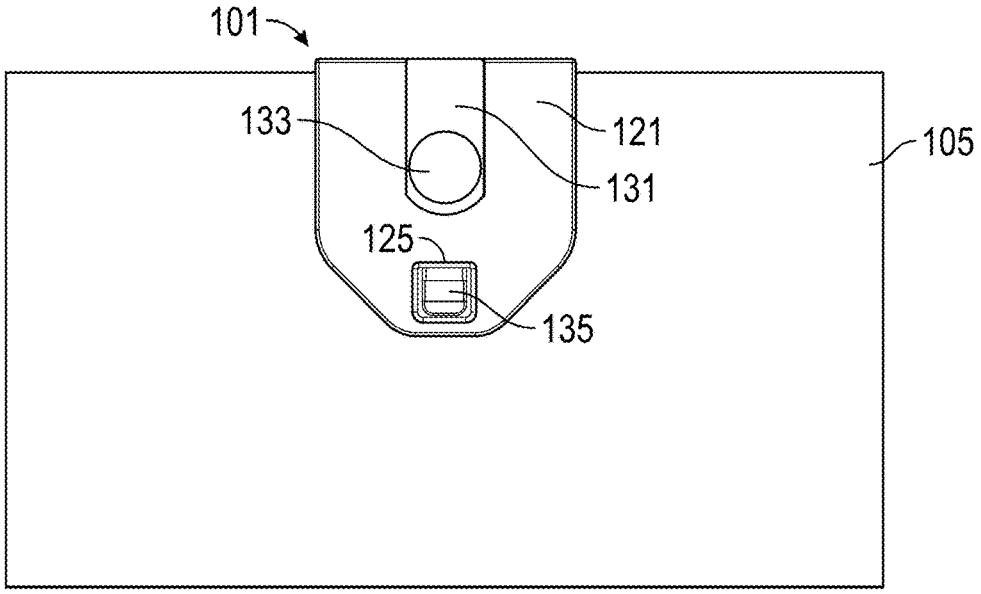
FIGS. 13-16 are front, top, bottom and side views, respectfully, of an embodiment of the T-shaped bearing and U-shaped mount assembled.
Figure 14:
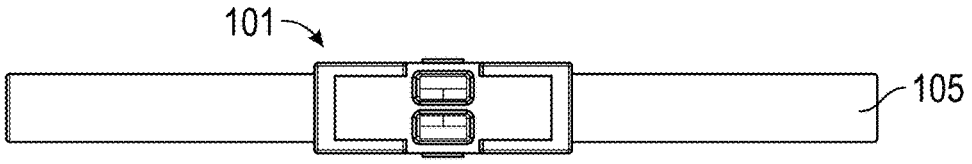
Figure 15:
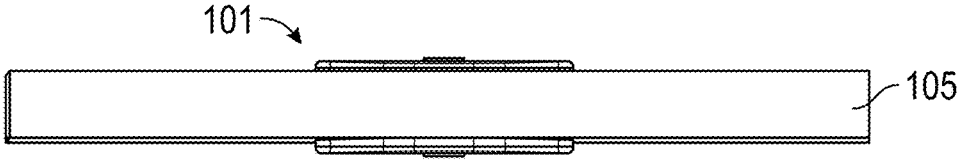
Figure 16:
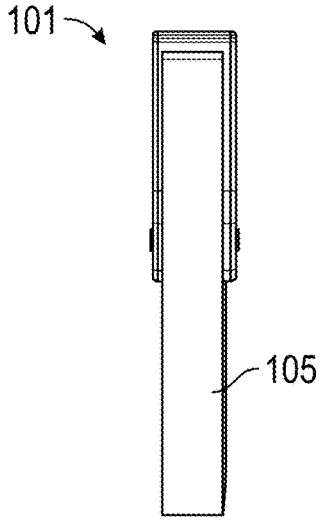

For example, FIGS. 1-16 disclose various embodiments of a quick release system 101 for a game table 103, such as a foosball table. The game table 103 can have rods 111 (e.g., foosball rods) with respective axes 113. As shown by the arrows in FIG. 1, the rods 111 can be independently axially slidable and rotatable about their respective axes 113 relative to the game table 103. Embodiments of the game table 103 can include the quick release system 101 for each rod 111. In some versions, there can be two quick release systems 101 for each rod 111.

Examples of the quick release system 101 can include a mount 121 having a slot 123, such as a vertical slot. The vertical slot 123 can be internal to the mount 121. The vertical slot 123 can extend downward to holes 125 (e.g., such as horizontal holes, one on each side) in the mount 121. The mount 121 can be mounted adjacent to respective top side walls 105 of the game table 103.

Embodiments of the quick release system 101 also can include bearings 131. Each bearing 131 can include an axial hole 133 (which can be horizontal) that is configured to receive a respective rod 111. Each bearing 131 also can have tabs 135 (e.g., such as two tabs 135). The tabs 135 can extend downward below the horizontal axial hole 133. The tabs 135 can mount and secure the respective rod 111 to the game table 103 by inserting the bearing 131 into a respective vertical slot 123 so that the tabs 135 engage and are retained by the respective, horizontal axial holes 125 in an engaged position (FIGS. 1 and 13-16). In a disengaged position (FIGS. 2-4), the tabs 135 can be manually released from the horizontal holes 125 to release the bearing 131 and the rod 111 from the mount 121, respectively.

Versions of the mount 121 can be U-shaped, as shown. In some examples, the vertical slot 123 can be U-shaped as well. Embodiments of the bearing 131 can be T-shaped. As shown by the arrows in FIG. 6, the tabs 135 can be flexible relative to the bearing 131. Versions of the mount 121 can have two horizontal holes 125, and the bearing 131 can have two tabs 135. In addition, the bearing 131 can have top flanges 137. In one example, the top flanges 137 can be flush (FIGS. 13 and 16) with a top of the mount 121 in the engaged position. In some embodiments, two quick release systems 101 can be provided for each rod 111.

Embodiments of a T-shaped bearing for a foosball table are described in this disclosure. In this detailed description, for purposes of explanation, numerous specific details are set forth to provide a thorough understanding of embodiments of the present invention. One skilled in the art will appreciate, however, that embodiments of the present invention may be practiced without these specific details.

The drawings depict embodiments of a T-shaped bearing and its corresponding U-shaped mount for a rotating rod of a foosball table, in accordance with various embodiments. Conventional customer setup or removal of the rotating rods of a foosball table does not involve adding or removing the rods directly. As described above, a foosball table includes holes on either side of the table through which the rotating rods are mounted. In order to insert or remove a rotating rod, it must be disassembled so that a portion of the rod can be inserted or removed through each of the mounting holes. Because of the disassembly and re-assembly required, each insertion or removal of a rotating rod can take a considerable amount of time and physical effort.

As a result, apparatus and methods are needed to reduce the time and physical effort needed to insert or remove a rotating rod of a foosball table.

In various embodiments, each rotating rod of a foosball table includes a T-shaped bearing at each end. The T-shaped bearing allows the rotating rod to rotate with respect to the T-shaped bearing. The rotating rod is then mounted to the foosball table by inserting each T-shaped bearing into a U-shaped mount attached to the table. Each rotating rod is then inserted or removed by inserting or removing the two T-shaped bearings into or from their corresponding U-shaped mounts. Various configurations of the T-shaped bearing and U-shaped mount are shown.

Other examples can include one or more of the following items.

1. A quick release system for a foosball rod of a foosball table, wherein the foosball rod has an axis and the foosball rod is axially slidable and rotatable about the axis relative to the foosball table, the quick release system comprising:
   a mount having a vertical slot that extends downward to and is in communication with horizontal holes in the mount, and the mount is configured to be mounted adjacent a top side wall of the foosball table; and
   a bearing having a horizontal axial hole that is configured to receive the foosball rod, the bearing also having tabs that extend downward below the horizontal axial hole to mount the foosball rod to the foosball table by inserting the bearing into the vertical slot so that the tabs engage and are retained by the horizontal holes, respectively, in an engaged position and, in a disengaged position, the tabs are manually released from the horizontal holes to release the bearing and the foosball rod from the mount.
2. The quick release system wherein the mount is U-shaped.
3. The quick release system wherein the vertical slot is U-shaped.
4. The quick release system wherein the bearing is T-shaped.
5. The quick release system wherein the tabs are flexible relative to the bearing.
6. The quick release system wherein the mount has two horizontal holes and the bearing has two tabs.
7. The quick release system wherein each bearing comprises top flanges.
8. The quick release system wherein the top flanges are flush with a top of the mount in the engaged position.
9. The quick release system wherein two quick release systems are provided for each foosball rod.
10. A foosball table, comprising:
    foosball rods with respective axes, the foosball rods are independently axially slidable and rotatable about their respective axes relative to the foosball table;
    a quick release system for each rod, the quick release system comprising:
    mounts each having a vertical slot that is internal and extends downward to horizontal holes in the mount, and the mounts are mounted adjacent to respective top side walls of the foosball table; and
    bearings each having a horizontal axial hole to receive a respective foosball rod, each bearing also having tabs that extend downward below the horizontal axial hole to mount the respective foosball rod to the foosball table by inserting the bearing into a respective vertical slot so that the tabs engage and are retained by the respective, horizontal holes in an engaged position and, in a disengaged position, the tabs are manually released from the horizontal holes to release the bearing and the foosball rod from the mount, respectively.
11. The foosball table wherein the mount is U-shaped.
12. The foosball table wherein the vertical slot is U-shaped.
13. The foosball table wherein the bearing is T-shaped.
14. The foosball table wherein the tabs are flexible relative to the bearing.
15. The foosball table wherein the mount has two horizontal holes and the bearing has two tabs.
16. The foosball table wherein each bearing comprises top flanges.
17. The foosball table wherein the top flanges are flush with a top of the mount in the engaged position.
18. The foosball table wherein two quick release systems are provided for each foosball rod.
19. A method of changing a game table from a foosball game to a second game, the method comprising:
    (a) providing the game table with foosball rods that have axes, each foosball rod is axially slidable and rotationally movable about a respective axis relative to the game table;
    (b) mounting each foosball rod to both side walls of the foosball table with respective quick release systems without using any tools or extra fasteners; and
    (c) to change the game table to the second game, manually releasing each foosball rod from the game table via the respective quick release systems without using any tools or extra fasteners.
20. The method wherein the second game is air hockey.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," "top", "bottom," and the like, may be used herein for ease of description to describe one element's or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated degrees or at other orientations) and the spatially relative descriptions used herein interpreted accordingly.

This written description uses examples to disclose the embodiments, including the best mode, and also to enable those of ordinary skill in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

It can be advantageous to set forth definitions of certain words and phrases used throughout this patent document. The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, can mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items can be used, and only one item in the list can be needed. For example, "at least one of: A, B, and C" includes any of the following combinations: A, B, C, A and B, A and C, B and C, and A and B and C.

Also, the use of "a" or "an" is employed to describe elements and components described herein. This is done merely for convenience and to give a general sense of the scope of the invention. This description should be read to include one or at least one and the singular also includes the plural unless it states otherwise.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, sacrosanct or an essential feature of any or all the claims.

After reading the specification, skilled artisans will appreciate that certain features which are, for clarity, described herein in the context of separate embodiments, can also be provided in combination in a single embodiment. Conversely, various features that are, for brevity, described in the context of a single embodiment, can also be provided separately or in any sub-combination. Further, references to values stated in ranges include each and every value within that range.

What is claimed is:

1. A quick release system for a foosball rod of a foosball table, wherein the foosball rod has an axis and the foosball rod is axially slidable and rotatable about the axis relative to the foosball table, the quick release system comprising:

a mount having a vertical slot that extends downward to and is in communication with horizontal holes in the mount, the horizontal holes extend in an axial direction parallel to the axis of the foosball rod completely through the mount, and the mount is configured to be mounted adjacent a top side wall of the foosball table; and a bearing having a horizontal axial hole that is configured to receive the foosball rod, the horizontal axial hole extends in an axial direction parallel to the axial direction of the horizontal holes in the mount, the bearing also having tabs that extend downward below the horizontal axial hole to mount the foosball rod to the foosball table by inserting the bearing into the vertical slot so that the tabs engage, extend axially into and are retained by the horizontal holes along the axial direction of the horizontal holes, respectively, in an engaged position and, in a disengaged position, the tabs are manually released from the horizontal holes to release the bearing and the foosball rod from the mount.

2. The quick release system of claim 1, wherein the mount is U-shaped.

3. The quick release system of claim 1, wherein the vertical slot is U-shaped.

4. The quick release system of claim 1, wherein the bearing is T-shaped.

5. The quick release system of claim 1, wherein the tabs are flexible relative to the bearing.

6. The quick release system of claim 1, wherein the mount has two of the horizontal holes and the bearing has two of the tabs.

7. The quick release system of claim 1, wherein each bearing comprises top flanges.

8. The quick release system of claim 7, wherein the top flanges are flush with a top of the mount in the engaged position.

9. The quick release system of claim 1, wherein two quick release systems are provided for the foosball rod.

10. A foosball table, comprising:

foosball rods with respective axes, the foosball rods are independently axially slidable and rotatable about their respective axes relative to the foosball table;

a quick release system for each of the foosball rods, the quick release system comprising:

mounts each having a vertical slot that is internal and extends downward to respective horizontal holes in the mount, the horizontal holes extend in an axial direction parallel to the axes of the foosball rods completely through the mount, and the mounts are mounted adjacent to respective top side walls of the foosball table; and bearings each having a horizontal axial hole to receive a respective one of the foosball rods, the horizontal axial hole extends in an axial direction parallel to the axial direction of the horizontal holes in the mount, each bearing also having tabs that extend downward below the horizontal axial hole to mount the respective foosball rod to the foosball table by inserting the bearing into a respective vertical slot so that the tabs engage, extend axially into and are retained by the respective, horizontal holes along the axial direction of the horizontal holes in an engaged position and, in a disengaged position, the tabs are manually released from the horizontal holes to release the bearing and the foosball rod from the mount, respectively.

11. The foosball table of claim 10, wherein each of the mounts is U-shaped.

12. The foosball table of claim 10, wherein the vertical slot is U-shaped.

13. The foosball table of claim 10, wherein each of the bearings is T-shaped.

14. The foosball table of claim 10, wherein the tabs are flexible relative to the bearings.

15. The foosball table of claim 10, wherein each of the mounts has two of the horizontal holes and each of the bearings has two of the tabs.

16. The foosball table of claim 10, wherein each each of the bearings comprises top flanges.

17. The foosball table of claim 16, wherein the top flanges are flush with a top of the mounts in the engaged position.

18. The foosball table of claim 10, wherein the quick release system comprises two quick release systems provided for each of the foosball rods.

* * * * *